US005803154A

United States Patent [19]

Sugawara et al.

[11] Patent Number: 5,803,154

[45] Date of Patent: Sep. 8, 1998

[54] THIXOCASTING PROCESS

[75] Inventors: Takeshi Sugawara; Nobuhiro Saito, both of Saitama, Japan

[73] Assignee: Honda Giken Kogyo Kabushiki Kaisha, Tokyo, Japan

[21] Appl. No.: 766,031

[22] Filed: Dec. 16, 1996

[30] Foreign Application Priority Data

Dec. 14, 1995 [JP] Japan ..... 7-347387
Dec. 2, 1996 [JP] Japan ..... 8-336409

[51] Int. Cl.[6] ..... B22D 18/02; B22D 23/00

[52] U.S. Cl. ..... 164/120; 164/900

[58] Field of Search ..... 164/113, 120, 164/900

[56] References Cited

U.S. PATENT DOCUMENTS 4,011,901 3/1977 Flemings et al. ..... 164/4
5,394,931 3/1995 Shiina et al. ..... 164/900

FOREIGN PATENT DOCUMENTS 489 662 A1 6/1992 European Pat. Off. .
572 683 A1 12/1993 European Pat. Off. .
40 15 174 A1 11/1991 Germany .
WO 95/19237 7/1995 WIPO .

OTHER PUBLICATIONS

Communication.
International Cast Metals Journal, vol. 1, No. 3 (Sep. 1976).
Numerical Simulation of Thixoforming (A. Zavaliangos and A. Lawley), Journal of Materials Engineering and Performance (Feb. 4, 1995, No. 1).

*Primary Examiner*—Joseph J. Hail, III
*Assistant Examiner*—I.-H. Lin
*Attorney, Agent, or Firm*—Lyon & Lyon LLP

[57] ABSTRACT

In a thixocasting process, a casting material is subjected to a heating treatment to prepare a semi-molten casting material having solid and liquid phases coexisting therein, and then, the semi-molten casting material is poured into a cavity under a pressure. A through-hole for applying a constricting effect to the material is provided in a flow path for the semi-molten casting material leading to the cavity in a casting mold. A material deforming pressure $P_1$ immediately before the semi-molten casting material flows into the through-hole is used as a parameter. For example, the material deforming pressure $P_1$ is equal to or lower than 6.7 MPa, it is determined that the material is satisfactorily filled in the cavity.

5 Claims, 21 Drawing Sheets

THIXOCASTING PROCESS

BACKGROUND OF THE INVENTION

1. Field of the Invention

The present invention relates to a thixocasting process, i.e., a process including the steps of subjecting a casting material to a heating treatment to prepare a semi-molten casting material having a solid phase (a substantially solid phase and so forth) and a liquid phase coexisting therein, and then pouring the semi-molten casting material under a pressure into a cavity in a casting mold.

2. Description of the Related Art

A fluidity test using a semi-molten casting material is conventionally known as a means for discriminating the satisfactory filling and the poor filling of the semi-molten casting material into the cavity in carrying out such a thixocasting process. Namely, if the flow length of the semi-molten casting material is equal to or larger than a defined length, the fluidity is discriminated as "good" for pouring of the semi-molten casting material into the cavity.

However, the conventional thixocasting process has a problem that a relatively large variability is liable to be produced in the flow length determined by the fluidity test, resulting in a low accuracy of discrimination of the satisfactory filling and the poor filling.

SUMMARY OF THE INVENTION

Accordingly, it is an object of the present invention to provide a thixocasting process of the above-described type, wherein the satisfactory filling and the poor filling of the semi-molten casting material into the cavity can be discriminated with a good accuracy in a course of allowing the semi-molten casting material to flow toward the cavity.

To achieve the above object, according to the present invention, there is provided a thixocasting process comprising the steps of: subjecting a casting material to a heating treatment to prepare a semi-molten casting material having solid and liquid phases coexisting therein: and then pouring the semi-molten casting material under a pressure into a cavity in a casting mold, wherein a through-hole for applying a constricting effect to the semi-molten casting material is provided in a flow path for the semi-molten casting material leading to the cavity in the casting mold, and a material deforming pressure $P_1$ when the semi-molten casting material flows into the through-hole is used as a parameter for discriminating the satisfactory filling and the poor filling of the semi-molten casting material into the cavity.

The material deforming pressure $P_1$ is easily detected, because it is definitely applied as a reaction force to a pressing plunger which is in operation to pour the semi-molten casting material under a pressure.

If the material deforming pressure $P_1$ permitting the semi-molten casting material to be poured into the cavity is previously determined, the satisfactory filling and the poor filling of the semi-molten casting material into the cavity can be discriminated with a good accuracy by the detected material deforming pressure in the course of execution of the thixocasting process.

A through-hole passage pressure when the semi-molten material is passed through the through-hole may be used as the discriminating parameter.

The above and other objects, features and advantages of the invention will become apparent from the following description of a preferred embodiment taken in conjunction with the accompanying drawings.

DETAILED DESCRIPTION OF THE PREFERRED EMBODIMENT

Figure 1:
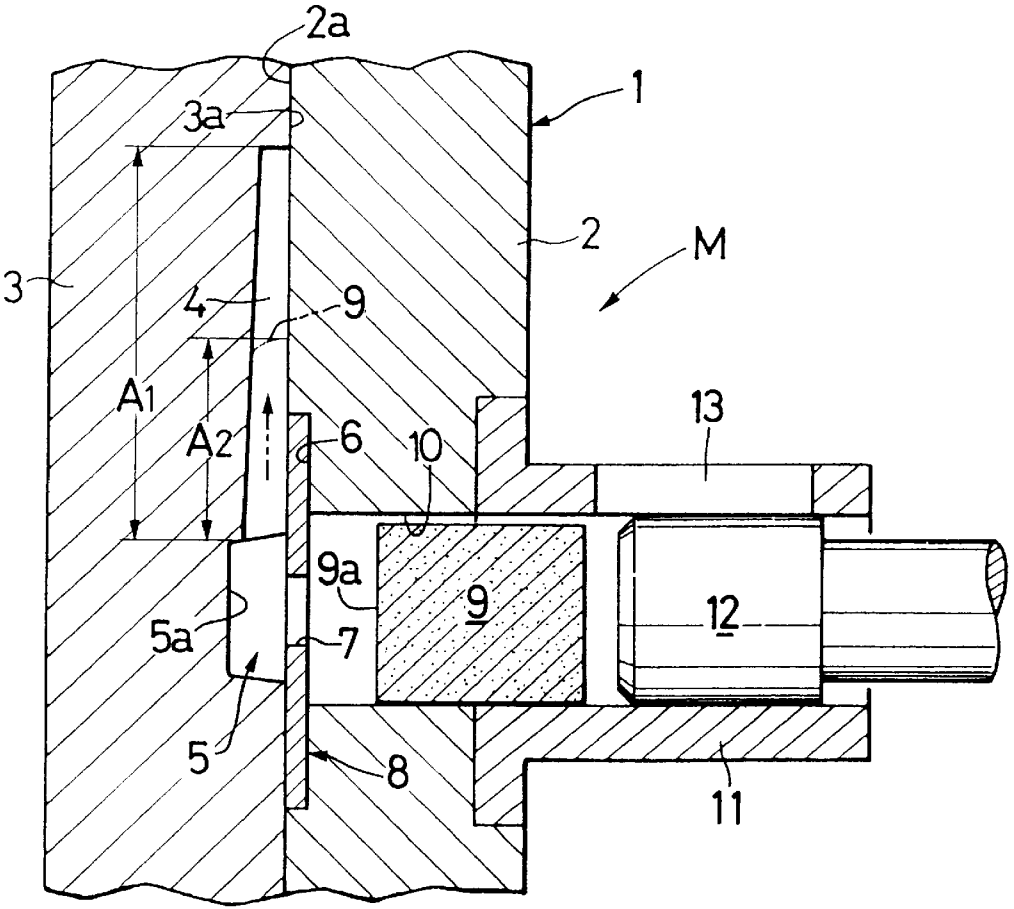
FIG. 1 is a vertical sectional view of a pressure casting machine.

A pressure casting machine M shown in FIG. 1 is used to produce a cast product by application of a thixocasting process using a casting material. The pressure casting machine M includes a casting mold 1 which includes a stationary die 2 and a movable die 3 which have vertical mating surfaces 2*a* and 3*a*, respectively. A cast product forming cavity 4 and an expansion chamber 5 communicating the cavity 4 are defined between both the mating surfaces 2*a* and 3*a*. A portion of the cavity 4 and an annular recess 6 facing the expansion chamber 5 are defined in the mating surface 2*a* of the stationary die 2, and a disk 8 having a through-hole 7 in its central portion is detachably fitted in the recess 6. A chamber 10 for placement of a semi-molten casting material 9 is defined in the stationary die 2 and communicates with the expansion chamber 5 through the through-hole 7. A sleeve 11 is horizontally mounted to the stationary die 2 and communicates with the chamber 10, and a pressing plunger 12 is slidably received in the sleeve for movement into and out of the chamber 10. The sleeve 11 has an insertion inlet 13 in an upper portion of its peripheral wall for receiving the semi-molten casting material 9.

The through-hole 7 has an inside diameter smaller than that of the sleeve 11 and hence, the through-hole 7 provides a constricting effect to the semi-molten casting material in a flow path for the semi-molten casting material leading to the cavity 4 in the casting mold 1. In the embodiment, the inside diameter of the through-hole 7 is set at 30 mm.

[I] Casting of aluminum alloy cast product

The following materials were prepared as casting materials: a stirred continuous-casting material having a composition comprising 7.2% by weight of Si, 0.6% by weight of Mg and balance of Al and subjected to an electromagnetic stirring treatment with an output power of 3 kW/hr at a melting temperature of 700° C.; and a usual continuous-casting material of an aluminum alloy having a composition similar to the above-described composition and produced at a melting temperature of 700° C. (which will be referred to as a usual continuous-casting material hereinafter).

Figure 2:
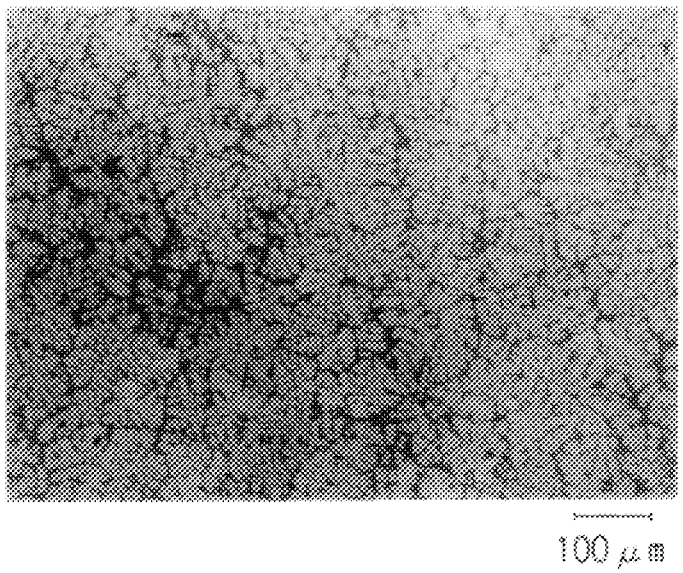
FIG. 2 is a photomicrograph showing the metallographic structure of a stirred continuous-casting material of an aluminum alloy.

FIG. 2 is a photomicrograph showing the metallographic structure of the stirred continuous-casting material. It can be seen from FIG. 2 that a primary crystal α-Al which is a primary crystal solid assumes a spherical shape.

Figure 3:
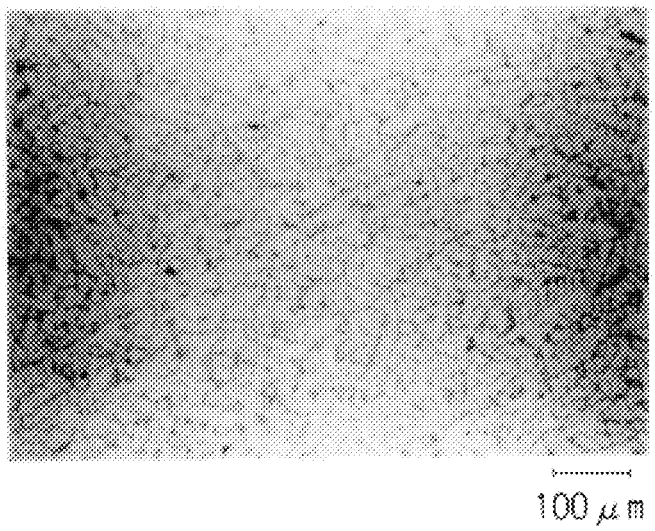
FIG. 3 is a photomicrograph showing the metallographic structure of a usual continuous-casting material of an aluminum alloy.
Figure 4:
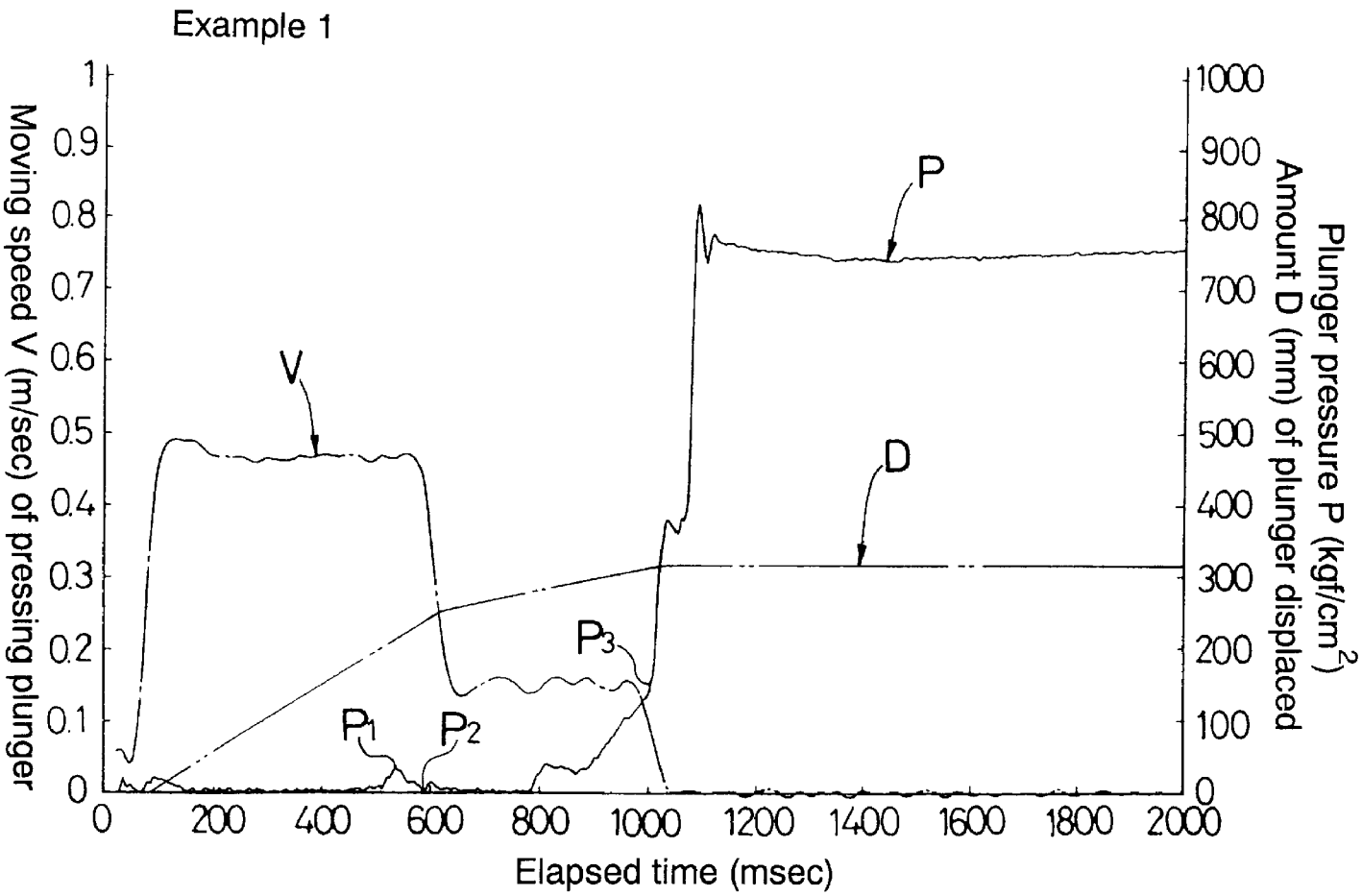
FIG. 4 is a graph illustrating the relationship between the lapsed time, the moving speed V of a pressing plunger, the amount D of pressing plunger displaced and the plunger pressure P in a thixocasting process using an example 1.
Figure 5:
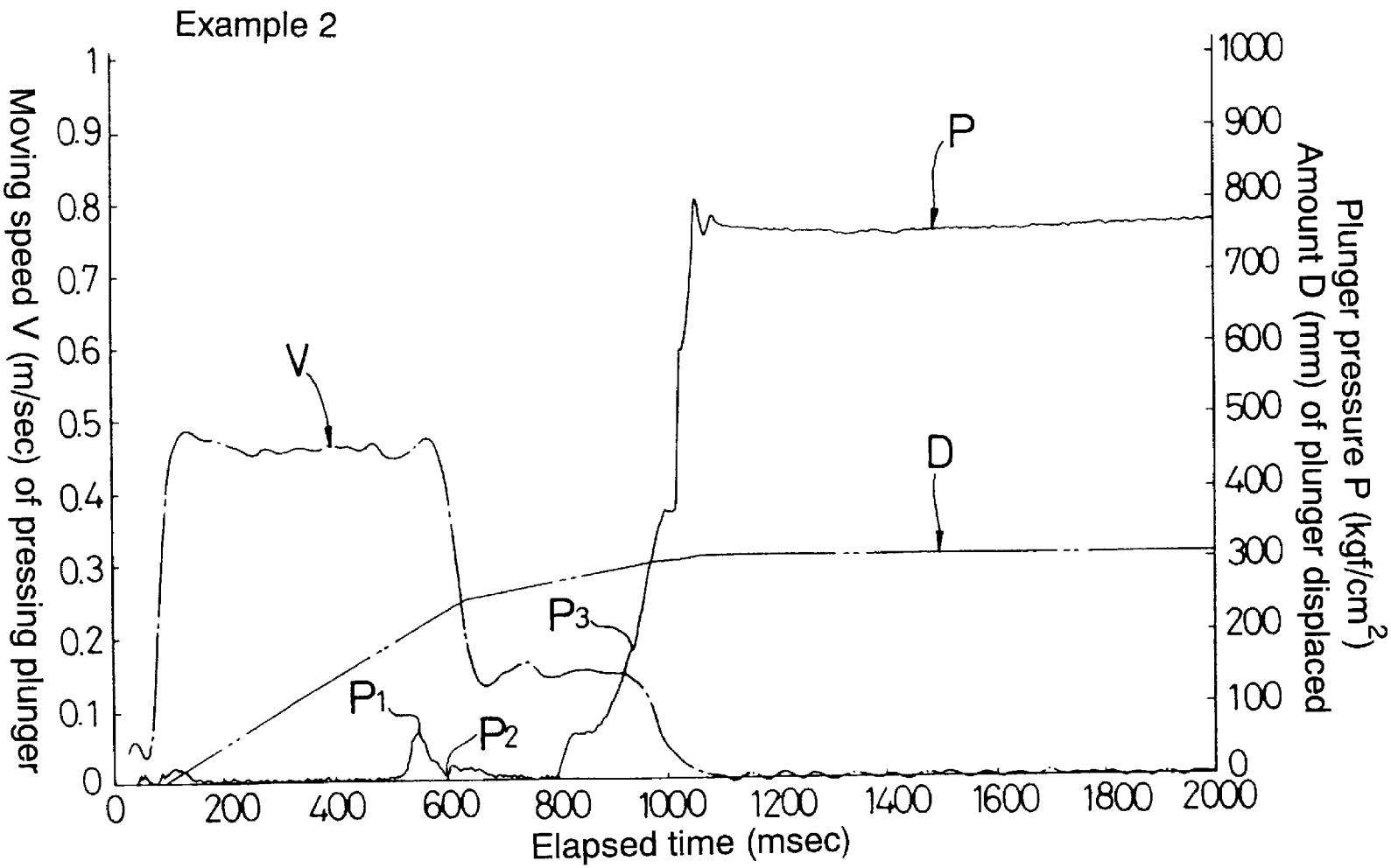
FIG. 5 is a graph illustrating the relationship between the lapsed time, the moving speed V of a pressing plunger, the amount D of pressing plunger displaced and the plunger pressure P in a thixocasting process using an example 2.
Figure 6:
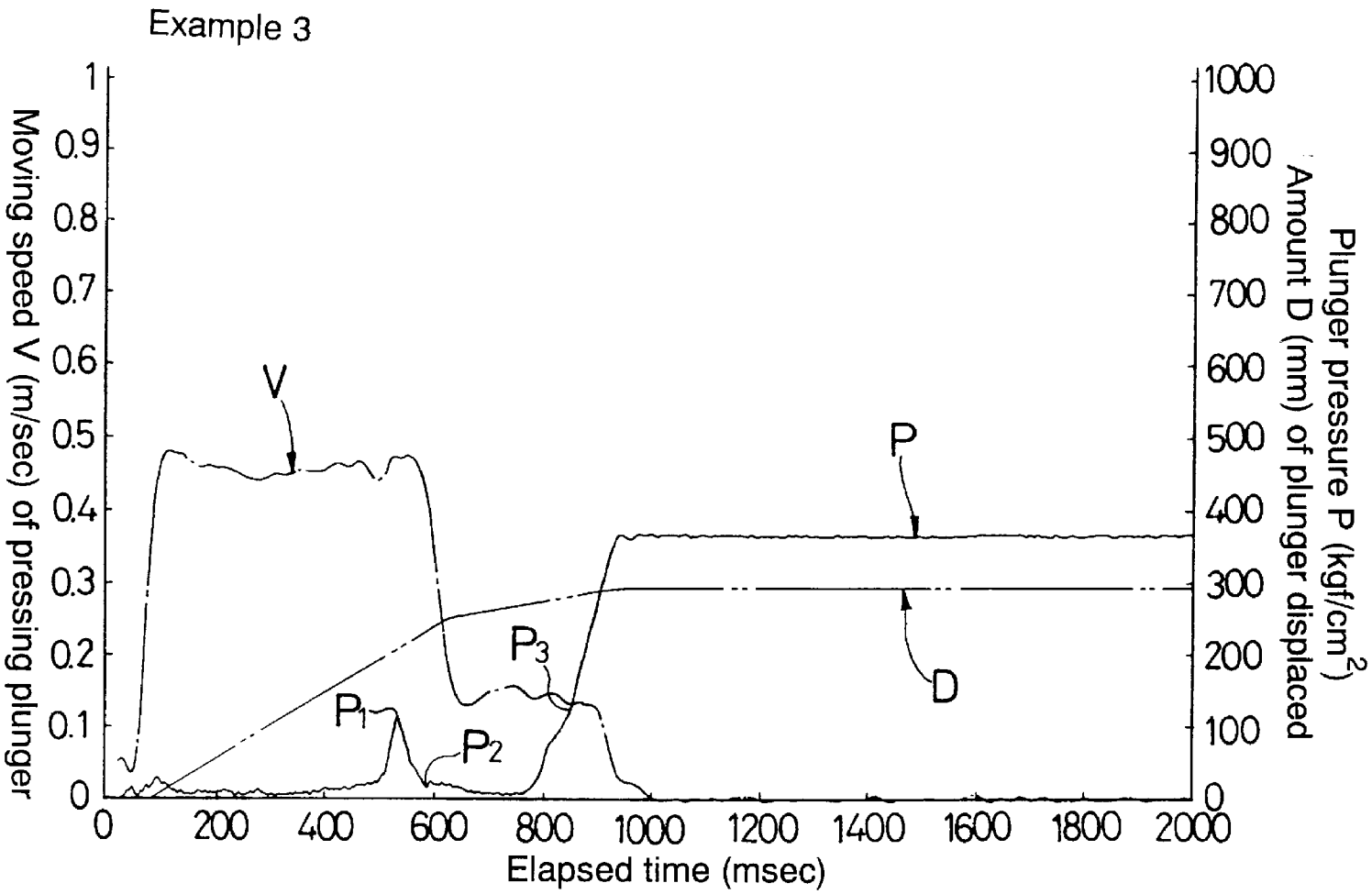
FIG. 6 is a graph illustrating the relationship between the lapsed time, the moving speed V of a pressing plunger, the amount D of pressing plunger displaced and the plunger pressure P in a thixocasting process using an example 3.
Figure 7:
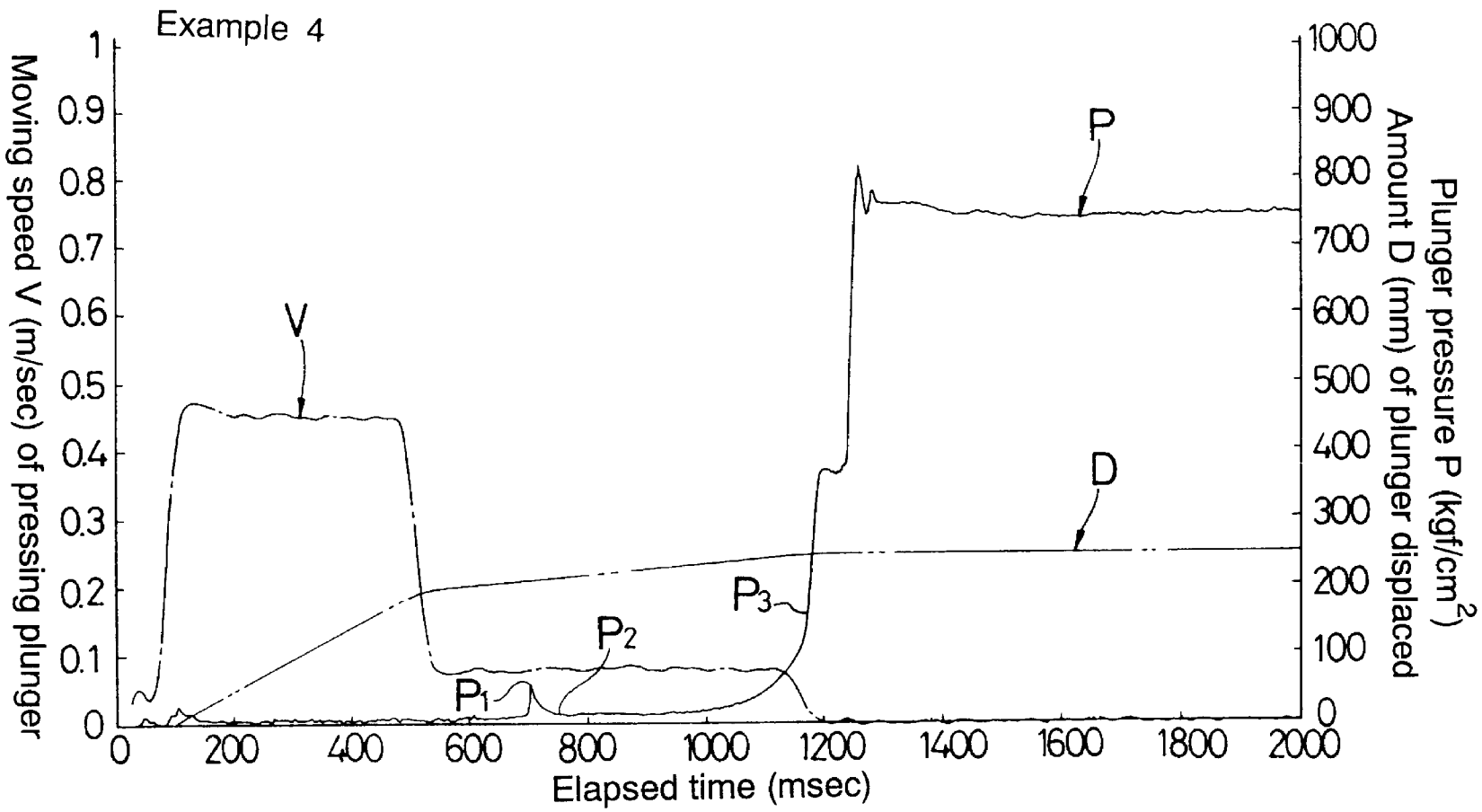
FIG. 7 is a graph illustrating the relationship between the lapsed time, the moving speed V of a pressing plunger, the amount D of pressing plunger displaced and the plunger pressure P in a thixocasting process using an example 4.
Figure 8:
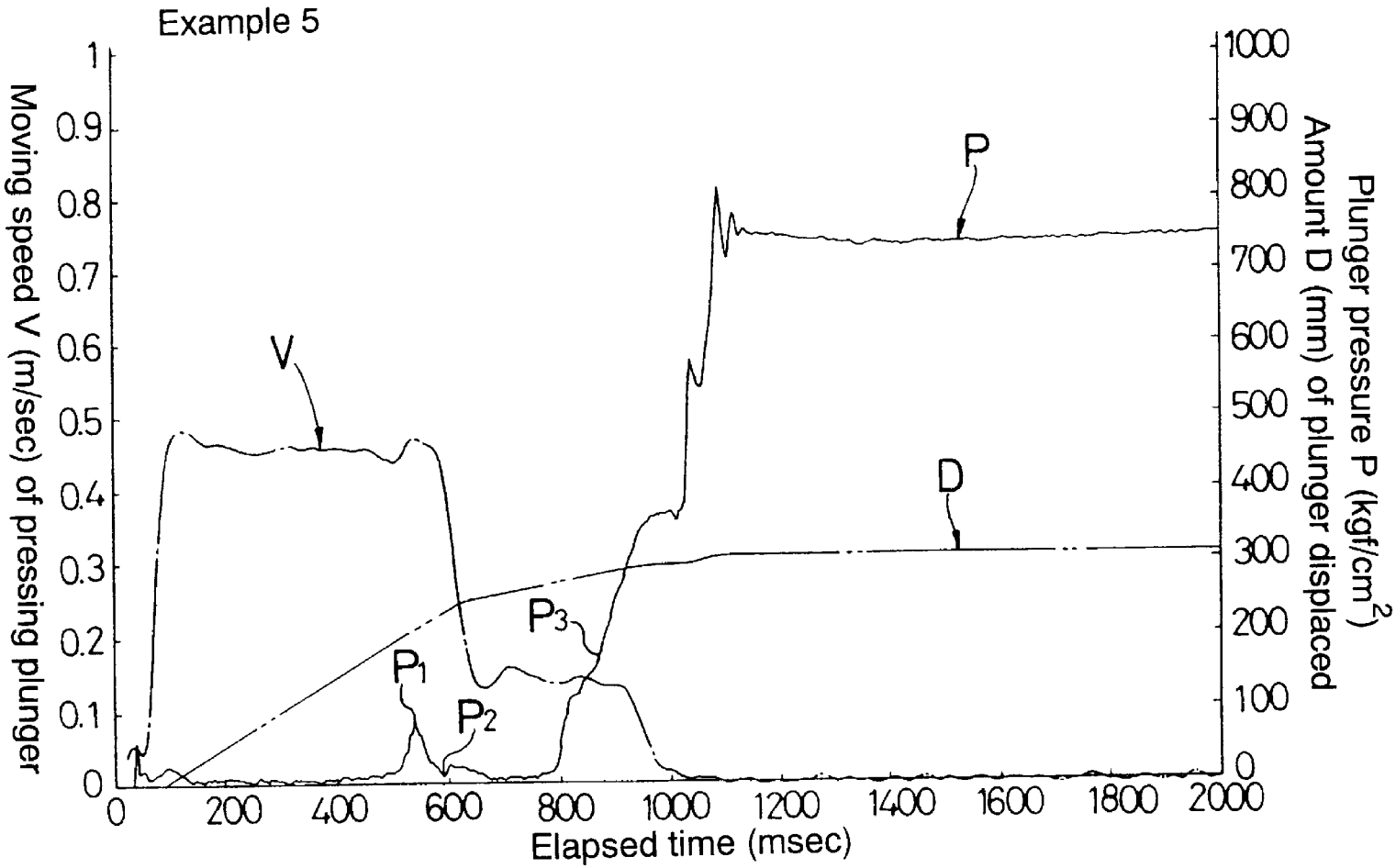
FIG. 8 is a graph illustrating the relationship between the lapsed time, the moving speed V of a pressing plunger, the amount D of pressing plunger displaced and the plunger pressure P in a thixocasting process using an example 5.
Figure 9:
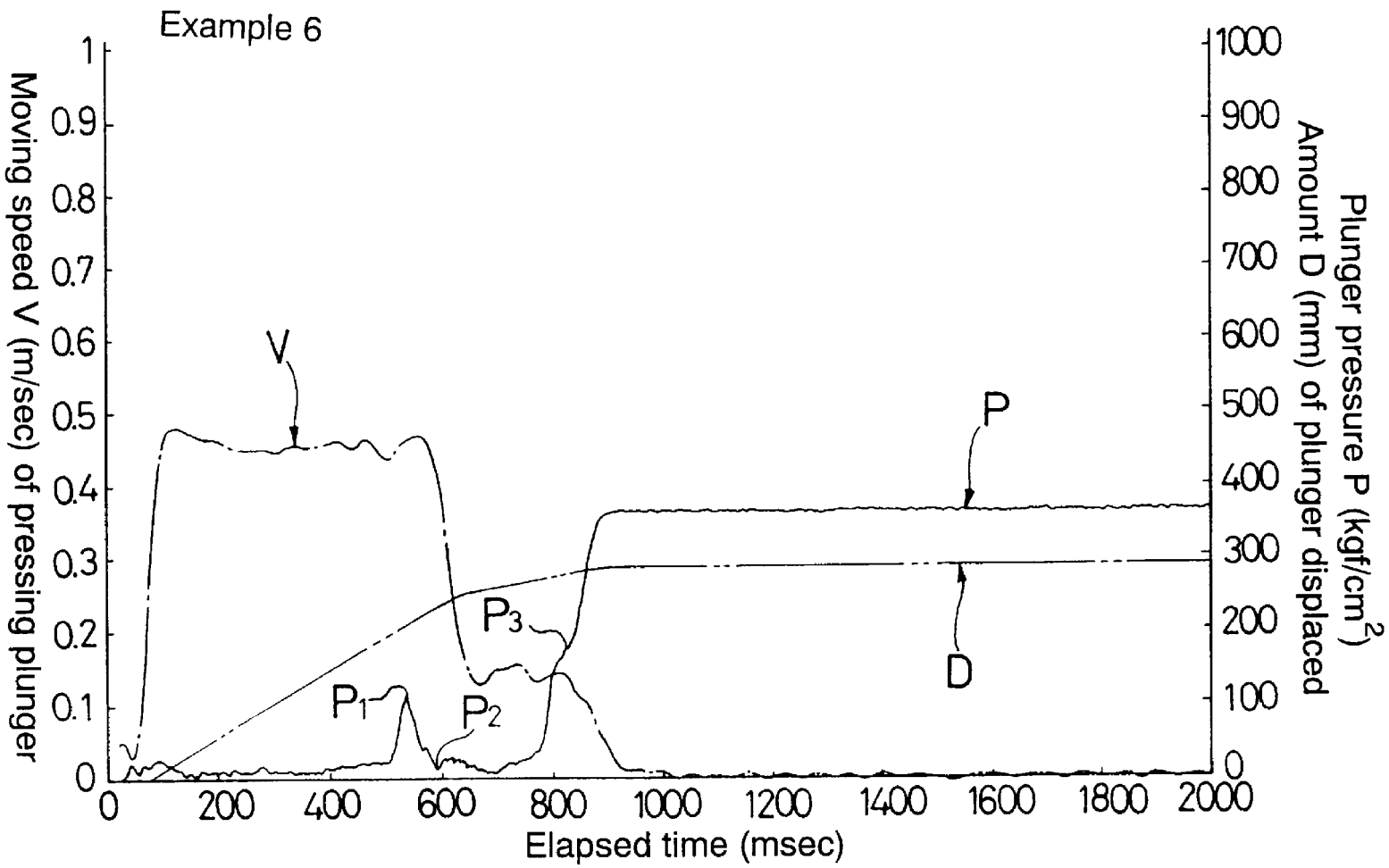
FIG. 9 is a graph illustrating the relationship between the lapsed time, the moving speed V of a pressing plunger, the amount D of pressing plunger displaced and the plunger pressure P in a thixocasting process using an example 6.

FIG. 3 is a photomicrograph showing of the usual continuous-casting material. It can be seen from FIG. 3 that a primary crystal α-Al assumes a dendrite shape.

Examples 1 to 3 of aluminum alloy materials having a diameter of 50 mm and a length of 65 mm were made from the stirred continuous-casting material, and examples 4 to 6 having the above-described size were made from the usual continuous-casting material.

The example 1 of the aluminum alloy material was placed into a heating coil in an induction heating device and then heated under conditions of a frequency of 1 kHz and a maximum output power of 37 kW to prepare an example 1 of a semi-molten aluminum alloy material 9. In this case, the heating temperature of the example 1 was 590° C., and the solid rate of the example 1 was 40%.

Thereafter, the example 1 of the semi-molten aluminum alloy material 9 was placed into the sleeve 11, as shown in FIG. 1, and poured into the cavity through the through-hole 7 and the expansion chamber 5, by starting the primary pressing step was started under conditions of a temperature of the example 1 of 590° C., temperatures of the stationary and movable dies 2 and 3 of 250° C. (but the temperature around the through-hole 7 was 300° C.); a temperature of the sleeve 11 of 180° C.; a clamping force of 200 tons; and a moving speed of the pressing plunger 12 including an initial speed of 0.5 m/sec and a first speed of 0.12 m/sec. In this case, most of the oxide film located on the front end face 9*a* in the pressing direction excluding a portion opposed to the through-hole 7 and the oxide film on the outer peripheral surface in the example 1 were left within the sleeve 11 in the vicinity of the through-hole. The oxide film at the portion opposed to the through-hole 7 is urged to the opposed wall of the expansion chamber 5 to the through-hole 7 and left within the expansion chamber 5.

The plunger pressure P at the completion of the primary pressing step was set at 35.3 MPa.

After the completion of the primary pressing step, the secondary pressing step for the example 1 was immediately started by the pressing plunger 12. In the secondary pressing step, the example 1 was solidified to provide an example 1 of an aluminum alloy cast product. The plunger pressure P in the secondary pressing step is set at 74.5 MPa, and the pressure retention time was set at 30 sec. The thixocasting process was carried out under the same conditions as those described above to produce examples 1 of a plurality of aluminum alloy cast products.

Then, the thixocasting process was carried out under the same conditions, except that examples 2 to 6 of aluminum alloy materials were used, and the heating temperature of the solid rate of the aluminum alloy materials were varied, thereby producing pluralities of examples 2 to 6 of aluminum alloy cast products. The examples 2 to 6 correspond to the examples 2 to 6 of the aluminum alloy materials, respectively.

FIGS. 4 to 9 shows the relationship between the lapsed time, the moving speed V of the pressing plunger 12, the amount of pressing plunger 12 displaced and the plunger pressure P. In FIGS. 4 to 9, $P_1$ indicates the material deforming pressure when the example 1 or the like flows into the through-hole 7; $P_2$ indicates the through-hole passage pressure when the example 1 or the like is passed through the through-hole 7; and $P_3$ indicates the cavity filling pressure for pouring the example 1 or the like into the cavity 4.

Table 1 shows the relationship between the temperature and the solid rate for the examples 1 to 6 in the semi-molten states, the various pressures provided from FIGS. 4 to 9, and the filling rate A and the yield for the examples 1 to 6 of the aluminum alloy cast products. The filling rate A was determined according to $A=(A_2/A_1)\times 100$ (%), wherein $A_1$ represents the entire length of the cavity 4, and $A_2$ represents the length of the semi-molten aluminum material 9 reaching the cavity 4, as shown in FIG. 1.

TABLE 1

| | Semi-molten Al alloy material | | | Plunger pressure P | | | Al alloy cast product | |
|---|---|---|---|---|---|---|---|---|
| Example | Type | Temperature (°C.) | Solid rate (%) | Material deforming pressure $P_1$ (MPa) | Through-hole passage pressure $P_2$ (MPa) | Cavity filling pressure $P_3$ (MPa) | Filling rate A (%) | Yield (%) |
| 1 | Stirred | 590 | 40 | 2.8 | 0.6 | 13.8 | 100 | 100 |
| 2 | continuous- | 575 | 70 | 6.7 | 1.1 | 17.6 | 100 | 100 |
| 3 | casting material | 570 | 90 | 11.2 | 1.3 | 12.7 | 24 | 0 |
| 4 | Usual | 610 | 20 | 5.8 | 1.1 | 15.7 | 100 | 100 |
| 5 | continuous- | 600 | 35 | 8.5 | 1.4 | 16.7 | 35 | 0 |
| 6 | casting material | 590 | 40 | 11.6 | 1.6 | 17.7 | 22 | 0 |

Figure 10:
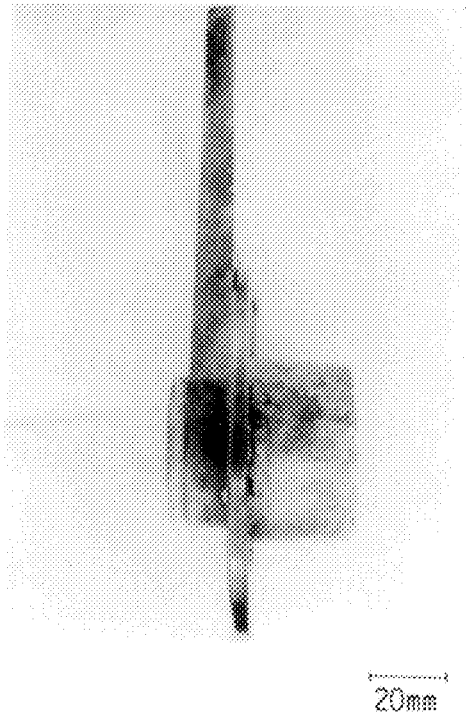
FIG. 10 is a photograph of an example 1 of an aluminum alloy cast product.

FIG. 10 is a photograph showing the example 1 of the aluminum alloy cast product. It can be seen from FIG. 10 that no cutout was produced, which indicates that the example 1 in the semi-molten state was certainly filled in the cavity 4. The flange-like portion in FIG. 10 is the disk 8 having the through-hole 7 in FIG. 1. The examples 2 and 4 of the aluminum alloy cast products had a normal form similar to that of the example 1, but cutouts were produced in the examples 3, 5 and 6.

Figure 11:
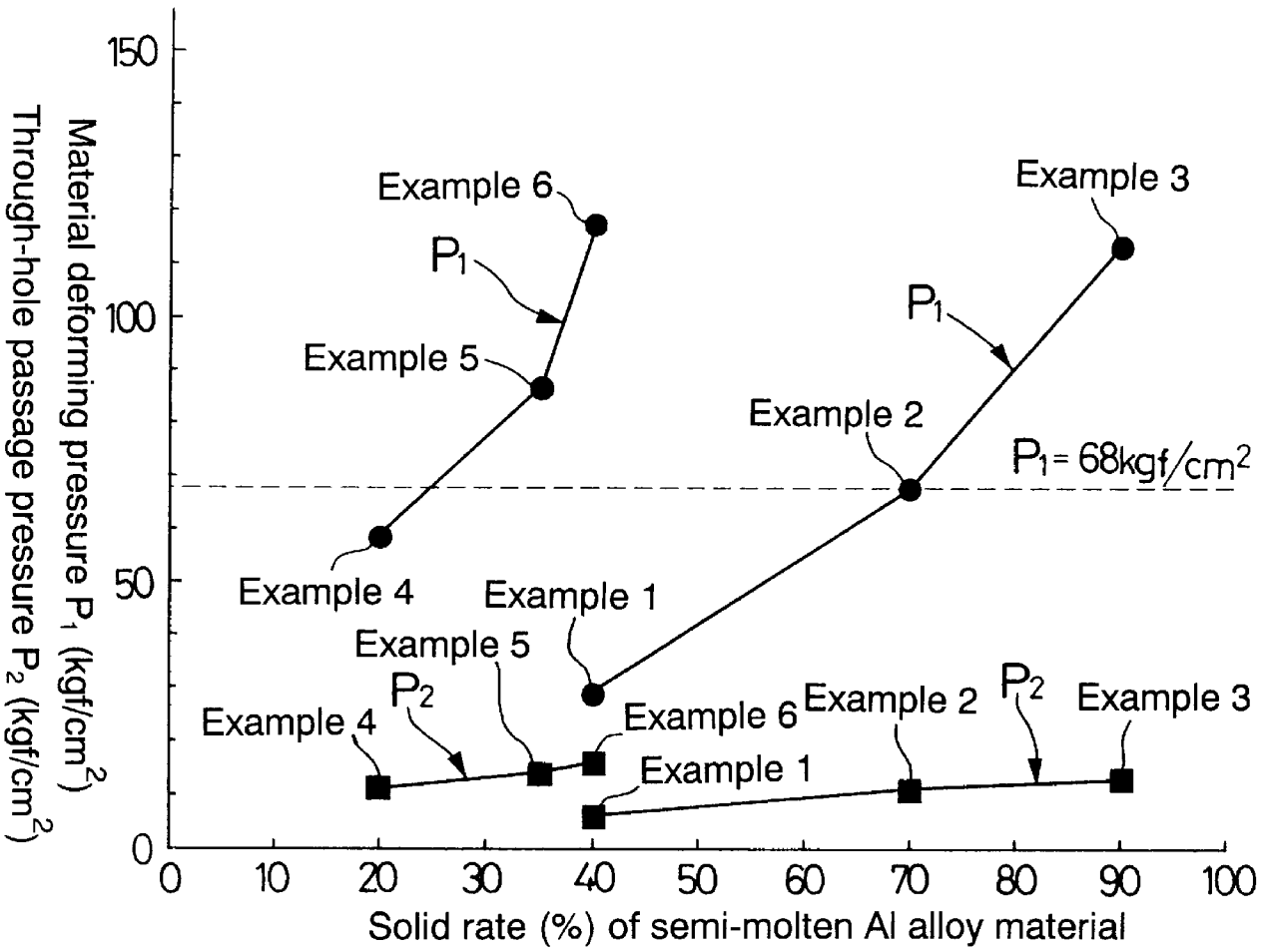
FIG. 11 is a graph illustrating the solid phase rate of a semi-molten aluminum alloy material, the material deforming pressure $P_1$ and the through-hole passage pressure $P_2$.

FIG. 11 is a graph taken based on Table 1 and illustrating the relationship between the solid rate, the material deforming pressure $P_1$ and the through-hole passage pressure $P_2$ for the semi-molten aluminum alloy materials.

As apparent from FIGS. 4 to 9, the material deforming pressure $P_1$ is easily detected, because it is definitely applied as a reaction force to the pressing plunger 12 which is in operation, to pouring the examples 1 to 6 of the semi-molten aluminum alloy materials under pressure.

Therefore, if the material deforming pressure $P_1$ (in this case, $P_1$6.7 MPa) enough to be able to fill the semi-molten aluminum alloy material into the cavity 4 is previously determined, the following is ensured: If the detected material deforming pressure $P_1$ is equal to or lower than 6.7 MPa, it can be determined that the material is satisfactorily filled in the cavity 4, and if the detected material deforming pressure $P_1$ is higher than 6.7 MPa, it can be determined that the filling is poor.

The through-hole passage pressure $P_2$ when the semi-molten aluminum alloy material is passed through the through-hole 7 can be used as the parameter for such discrimination of the satisfactory filling and the poor filling.

If the examples 1 and 6 are compared with each other in FIG. 11, the example 1 of the aluminum alloy cast product is a non-defective product, whereas the example 6 of the aluminum alloy cast product is a defective product, notwithstanding that they have the same solid rate. From the above fact, it may be safely mentioned that the initial crystal α-Al in the aluminum alloy material would rather assume a spherical shape.

Then, the usual continuous-casting material was melted at 630° C. to prepare a molten metal having a solid rate of 0%. The molten metal was then introduced into the sleeve 11 and subjected to a die-casting process under the same conditions as those described above to provide an aluminum alloy cast product.

Figure 12:
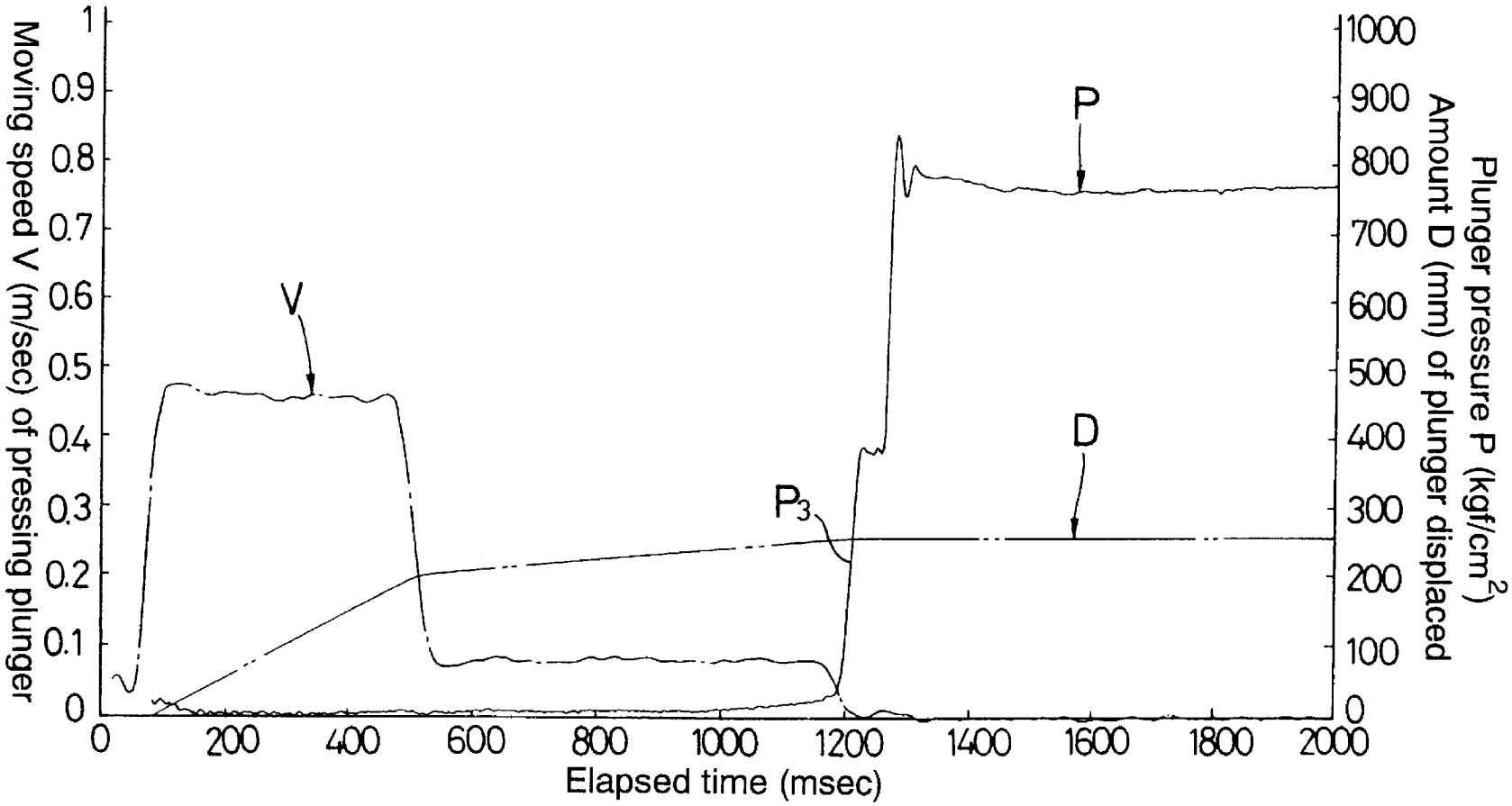
FIG. 12 is a graph illustrating the lapsed time, the moving speed V of a plunger, the amount D of plunger displaced and the plunger pressure P in a die-cast process using a usual continuous-casting material.

FIG. 12 shows the relationship between the lapsed time, the moving speed V of the pressing plunger 12, the amount of pressing plunger 12 displaced and the plunger pressure P in the die-casting process. In this case, the material deforming pressure $P_1$=1.0 MPa, the through-hole passage pressure $P_2$=1.0 MPa, the cavity filling pressure $P_3$=1.2 MPa, and a peak of the material deforming pressure $P_1$ was not generated. No cutout was produced in the aluminum alloy cast product made in this die-casting process.

[II] Casting of iron alloy cast product

The following casting materials were produced using a sand mold at a melting temperature of 1,400° C.: a hypo-eutectic iron alloy material having a composition consisting of 2% by weight of carbon (C), 2% by weight of silicon (Si) and the balance of iron (Fe) (including Mn, S and P as inevitable impurities), and an eutectic iron alloy material having a composition consisting of 3.5% by weight of carbon (C), 3.1% by weight of silicon (Si), 0.6% by weight of manganese (Mn), 0.1% by weight of phosphorus (P), 0.1% by weight of sulfur (S) and the balance of iron (Fe).

Figure 13:
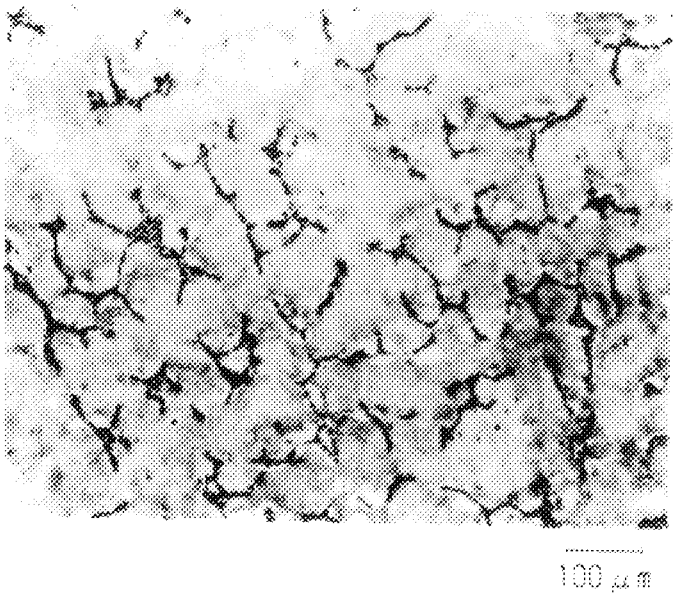
FIG. 13 is a photomicrograph showing the metallographic structure of an eutectic crystal iron alloy material.
Figure 14:
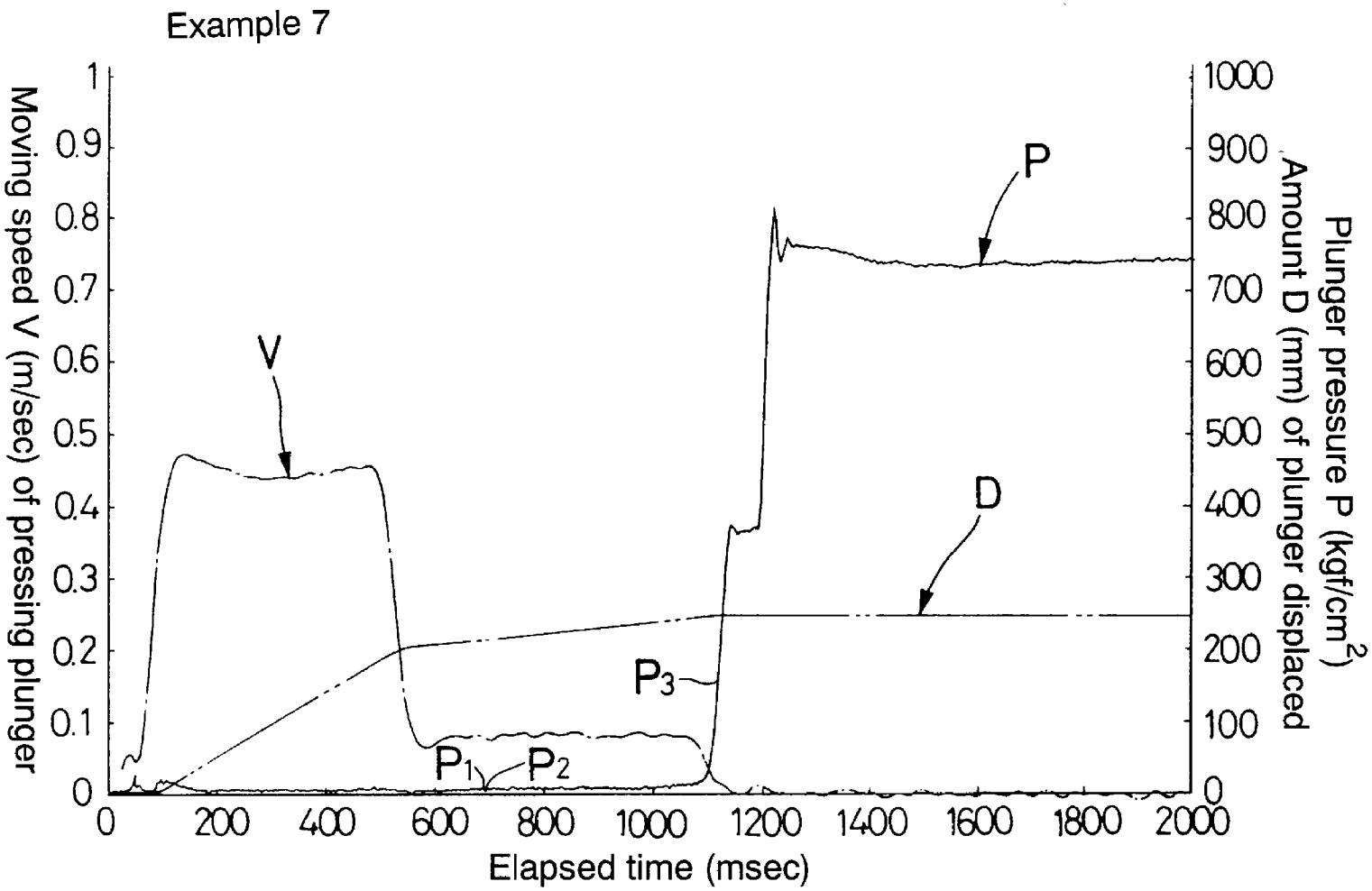
FIG. 14 is a graph illustrating the relationship between the lapsed time, the moving speed V of a plunger, the amount D of plunger displaced and the plunger pressure P in a thixocasting process using an example 7.
Figure 15:
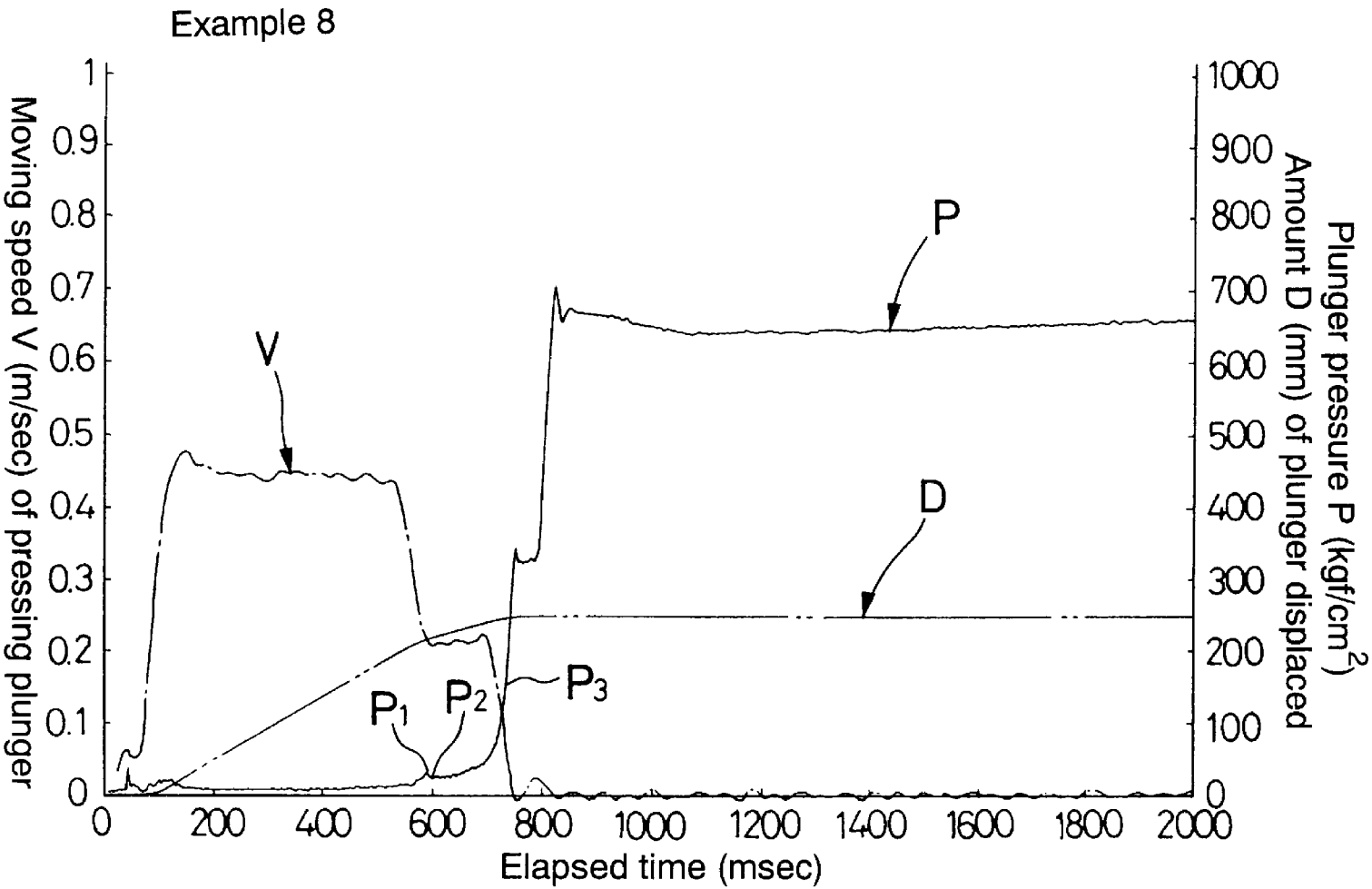
FIG. 15 is a graph illustrating the relationship between the lapsed time, the moving speed V of a plunger, the amount D of plunger displaced and the plunger pressure P in a thixocasting process using an example 8.
Figure 16:
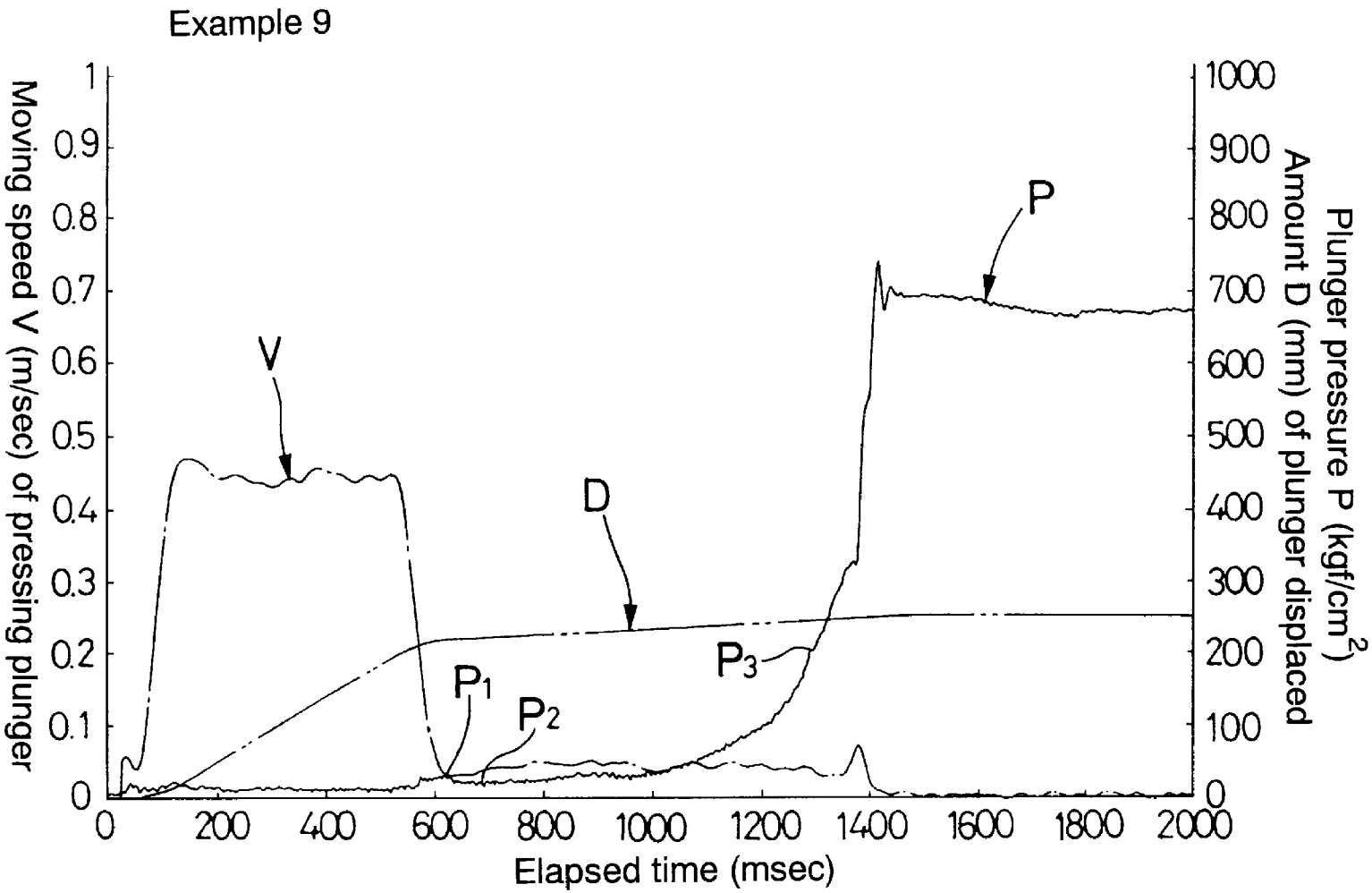
FIG. 16 is a graph illustrating the relationship between the lapsed time, the moving speed V of a plunger, the amount D of plunger displaced and the plunger pressure P in a thixocasting process using an example 9.
Figure 17:
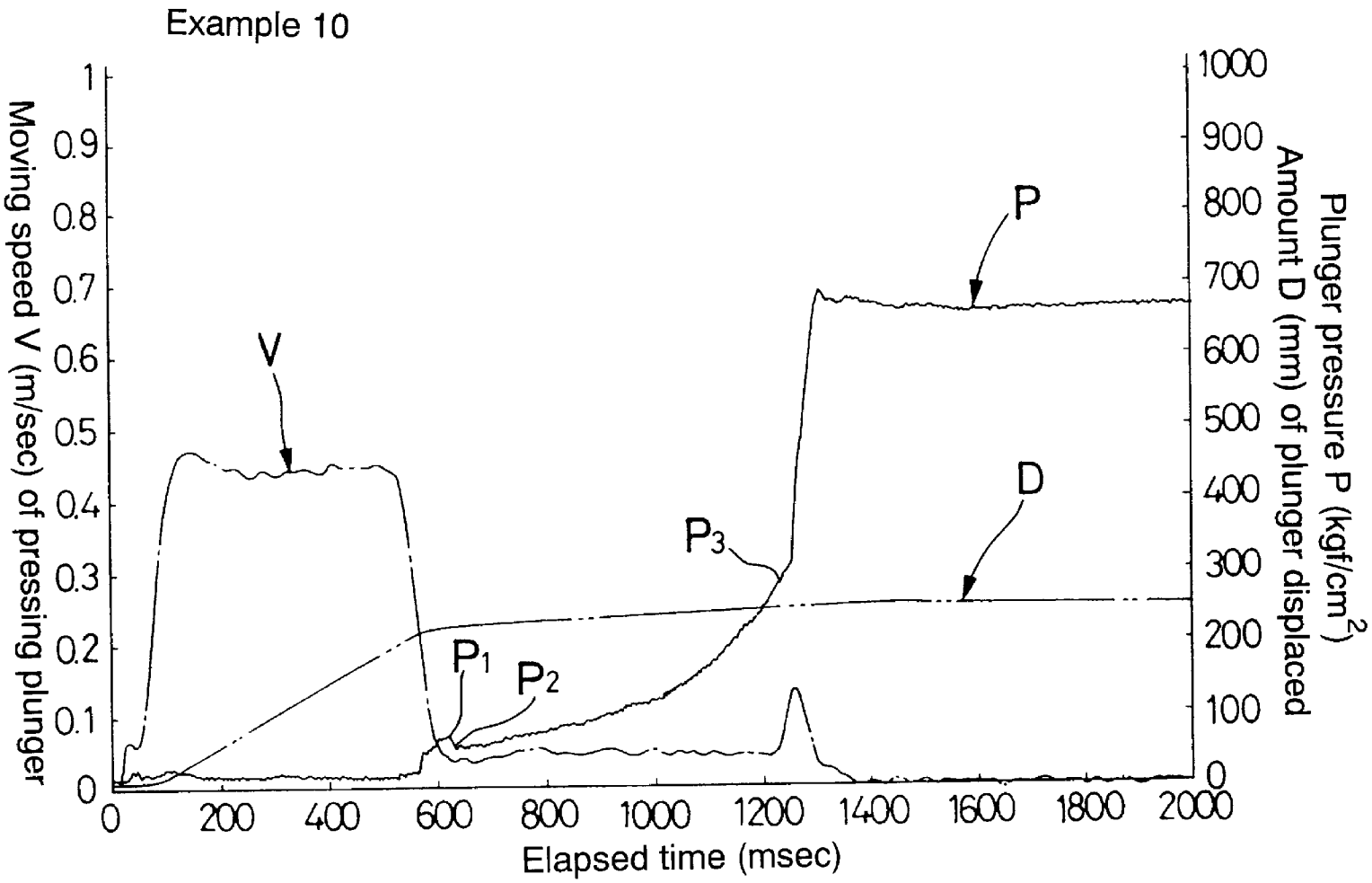
FIG. 17 is a graph illustrating the relationship between the lapsed time, the moving speed V of a plunger, the amount D of plunger displaced and the plunger pressure P in a thixocasting process using an example 10.
Figure 18:
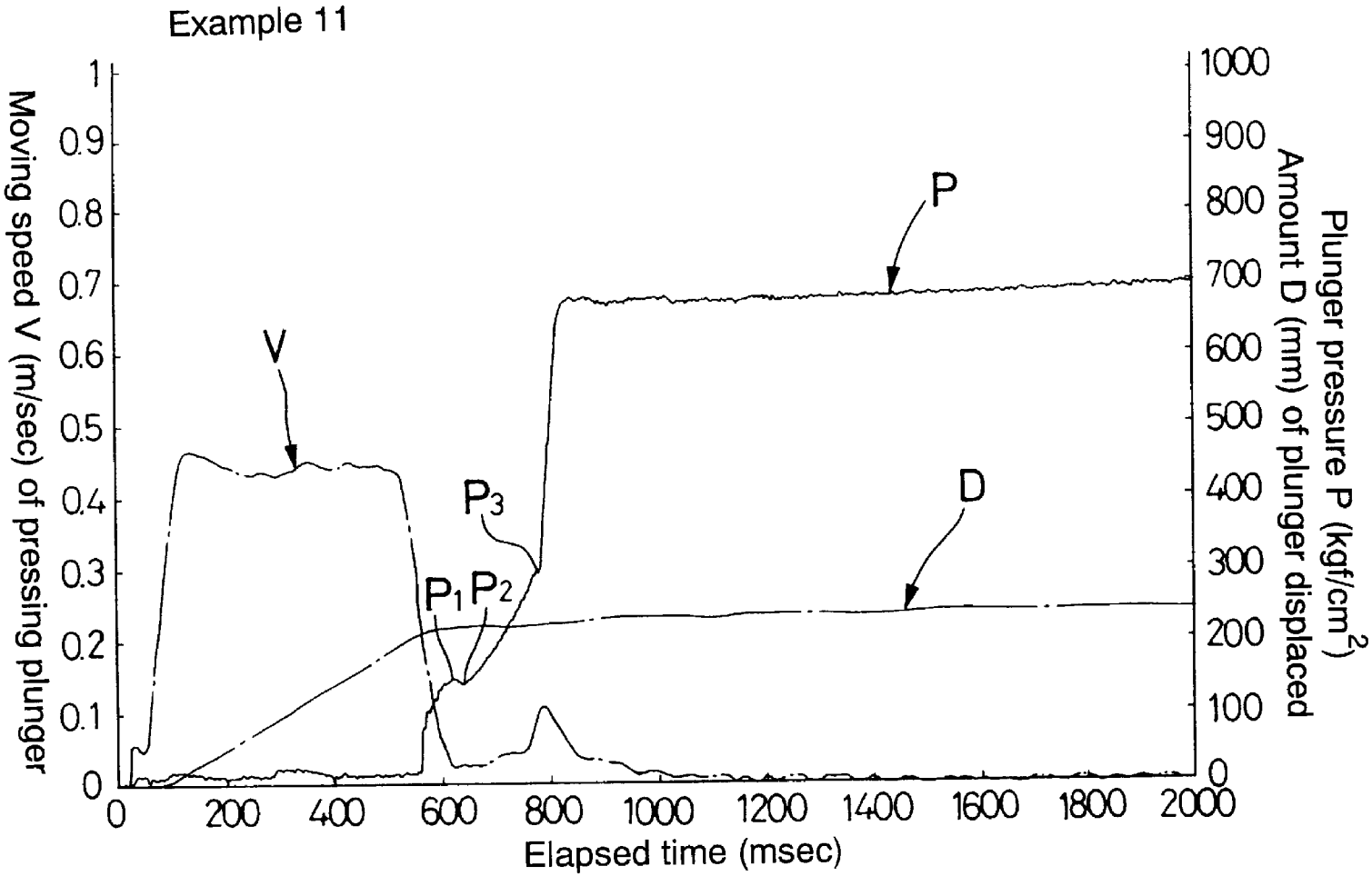
FIG. 18 is a graph illustrating the relationship between the lapsed time, the moving speed V of a plunger, the amount D of plunger displaced and the plunger pressure P in a thixocasting process using an example 11.

FIG. 13 is a photomicrograph showing the metallographic structure of the hypo-eutectic iron alloy material. It can be seen from FIG. 13 that the pearlite assumes a dendrite shape.

Examples 7 to 11 of iron alloy materials having a diameter of 50 mm and a length of 65 mm were made from the hypo-eutectic iron alloy material, and examples 12 and 13 having the same size as that described above were made from the eutectic iron alloy material.

The iron alloy material example 7 was placed into a heating coil in an induction heating device then heated under conditions of a frequency of 0.9 kHz and a maximum output power of 37 kW to prepare an example 7 of a semi-molten iron alloy material 9 having solid and liquid phases coexisting therein. In this case, the heating temperature of the example 7 was of 1,260° C., and the solid rate of the example 7 was of 40.1%.

Thereafter, the example 7 of the semi-molten iron alloy material 9 was placed into the sleeve 11, as shown in FIG. 1, and poured into the cavity 4 through the through-hole 7 and the expansion chamber 5, by starting the primary pressing step was started under conditions of a temperature of the example 7 of 1260° C., the solid rate of the example 7 of 40.1%, temperatures of the stationary and movable dies 2 and 3 of 260° C. (but the temperature around the through-hole 7 was 300° C.); a temperature of the sleeve 11 of 180° C.; a clamping force of 200 tons; and a moving speed of the pressing plunger 12 including an initial speed of 0.5 m/sec and a first speed of 0.08 m/sec. In this case, most of the oxide film located on the front end face 9*a* in the pressing direction excluding a portion opposed to the through-hole 7 and the oxide film on the outer peripheral surface in the example 7 were left within the sleeve 11 in the vicinity of the through-hole 7. The oxide film at the portion opposed to the through-hole 7 is urged to the opposed wall of the expansion chamber 5 to the through-hole 7 and left within the expansion chamber 5.

The plunger pressure P at the completion of the primary pressing step was set at 35.3 MPa.

After the completion of the primary pressing step, the secondary pressing step for the example 7 was immediately started by the pressing plunger 12. In the secondary pressing step, the example 1 was solidified to provide an example 7 of an iron alloy cast product. The plunger pressure P in the secondary pressing step was set at 74.5 MPa, and the pressure retention time was set at 35 sec. The thixocasting process was carried out under the same conditions as those described above to produce examples 7 of a plurality of iron alloy cast products.

Then, the thixocasting process was carried out under the same conditions, except that examples 8 to 13 of iron alloy materials were used, and the heating temperature of the solid rate of the iron alloy materials were varied, thereby producing pluralities of examples 8 to 13 of iron alloy cast products. The examples 8 to 13 correspond to the examples 8 to 13 of the iron alloy materials, respectively.

FIGS. 14 to 18 shows the relationship between the lapsed time, the moving speed V of the pressing plunger 12, the amount D of pressing plunger 12 displaced and the plunger pressure P. In FIGS. 4 to 9, $P_1$, $P_2$ and $P_3$ indicate the material deforming pressure, the through-hole passage pressure and the cavity filling pressure for pouring, respectively, as described above.

Table 2 shows the relationship between the temperature and the solid rate for the examples 7 to 13 in the semi-molten states, the various pressures, and the filling rate A and the yield for the examples 7 to 13 of the iron alloy cast products. The filling rate A was determined in the same manner as described above.

aluminum alloy material) enough to be able to fill the semi-molten Fe alloy material into the cavity 4 is previously determined, the following is ensured: If the detected material deforming pressure $P_1$ is equal to or lower than 6.7 MPa, it can be determined that the material is satisfactorily filled in the cavity 4, on the one hand, and if the detected material deforming pressure $P_1$ is higher than 6.7 MPa, it can be determined that the filling is poor.

The through-hole passage pressure $P_2$ when the semi-molten iron alloy material is passed through the through-hole 7 can be used as the parameter for such discrimination of the satisfactory filling and the poor filling.

Then, the hypo-eutectic iron alloy material was melted at 1,400° C. to prepare a molten metal having a solid rate of 0%. The molten metal was then introduced into the sleeve 11 and subjected to a die-casting process under the same conditions as those described above to provide an iron alloy cast product.

The relationship of the lapsed time to the moving speed V of the pressing plunger 12, the amount of pressing plunger 12 displaced and the plunger pressure P in the die-casting process is the same as in FIG. 12. The material deforming pressure $P_1$, the through-hole passage pressure $P_2$ and the cavity filling pressure $P_3$ are, of course, the same as those in the above-described die-casting process, and a peak of the material deforming pressure $P_1$ was not generated. No cutout was produced in the iron alloy cast product made in this die-casting process.

[III] Relationship between material deforming pressure $P_1$ and yield as well as filling rate A.

Figure 20:
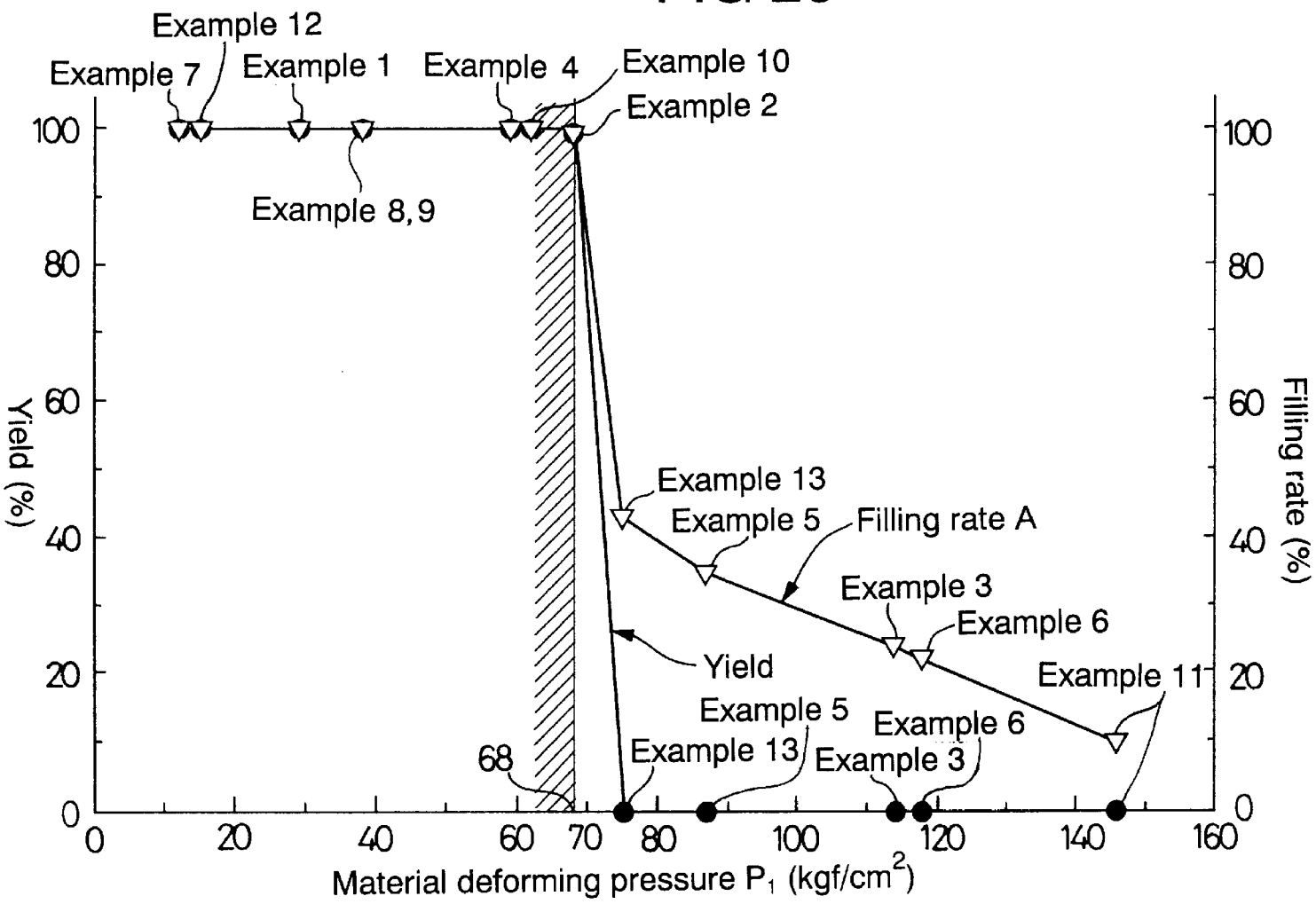
FIG. 20 is a graph illustrating the material deforming pressure $P_1$, the yield of a cast product and the pouring rate A.

FIG. 20 is a graph taken based on Tables 1 and 2 and illustrating the relationship between the material deforming pressure $P_1$ and the yield as well as the filling rate A. As apparent from FIG. 20, the yield and the filling rate A can be increased to 100% by setting the material deforming pressure $P_1$ in a range of $P_1 \leqq 6.7$ MPa.

TABLE 2

| | Semi-molten Fe alloy material | | | Plunger pressure P | | | Fe alloy cast product | |
|---|---|---|---|---|---|---|---|---|
| Example | Type | Temperature (°C.) | Solid rate (%) | Material deforming pressure $P_1$ (MPa) | Through-hole passage pressure $P_2$ (MPa) | Cavity filling pressure $P_3$ (MPa) | Filling rate A (%) | Yield (%) |
| 7 | Hypo- | 1260 | 40.1 | 1.2 | 1.0 | 29.2 | 100 | 100 |
| 8 | eutectic Fe | 1220 | 59.5 | 3.7 | 1.9 | 32.5 | 100 | 100 |
| 9 | alloy | 1200 | 68.2 | 3.7 | 1.4 | 31.1 | 100 | 100 |
| 10 | | 1185 | 74.3 | 6.1 | 4.6 | 27.4 | 100 | 100 |
| 11 | | 1160 | 83.6 | 14.3 | 13.5 | 25.5 | 10 | 0 |
| 12 | Eutectic Fe | 1140 | 63 | 1.5 | 1.2 | 16.9 | 100 | 100 |
| 13 | alloy | 1125 | 91 | 7.4 | 6.5 | 16.0 | 42 | 0 |

Each of the examples 7 to 10 and 12 of the iron alloy cast products had a normal form as in the case shown in FIG. 10, but cutouts were produced in the examples 11 and 13.

Figure 19:
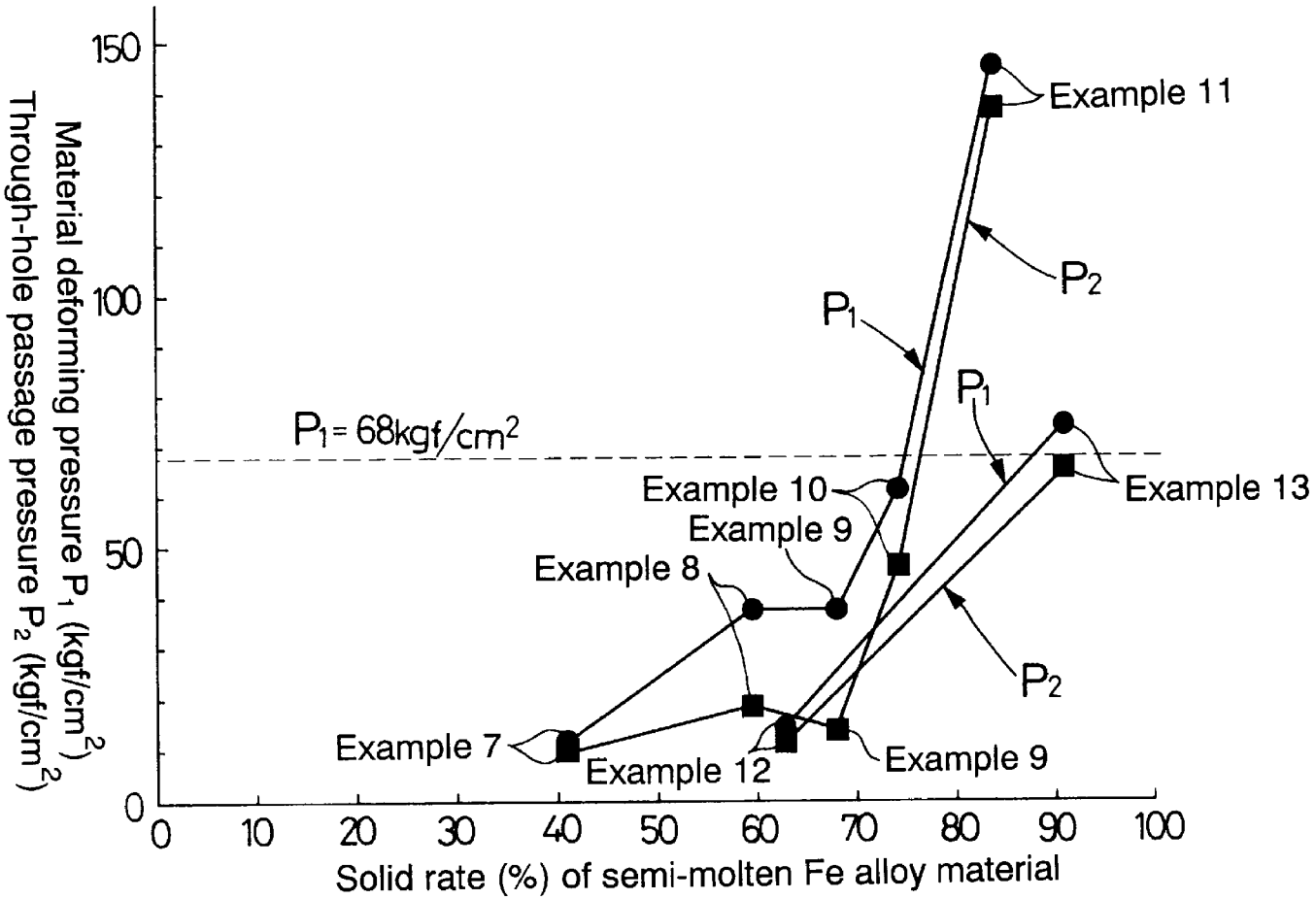
FIG. 19 is a graph illustrating the relationship between the solid rate of a semi-molten iron alloy material, the material deforming pressure $P_1$ and the through-hole passage pressure $P_2$.

FIG. 19 is a graph, made based on Table 2, showing the relationship between the solid rate of a semi-molten iron alloy material, the material deforming pressure $P_1$ and the through-hole passage pressure $P_2$.

As apparent from FIGS. 14 to 18, the material deforming pressure $P_1$ is easily detected, because it is definitely applied as a reaction force to the pressing plunger 12 which is in operation, to pouring the examples 7 to 13 of the semi-molten iron alloy materials under pressure.

Thereupon, if the material deforming pressure PI (in this case, $P_1$=6.7 MPa from the relation to the above-described

Figure 21:
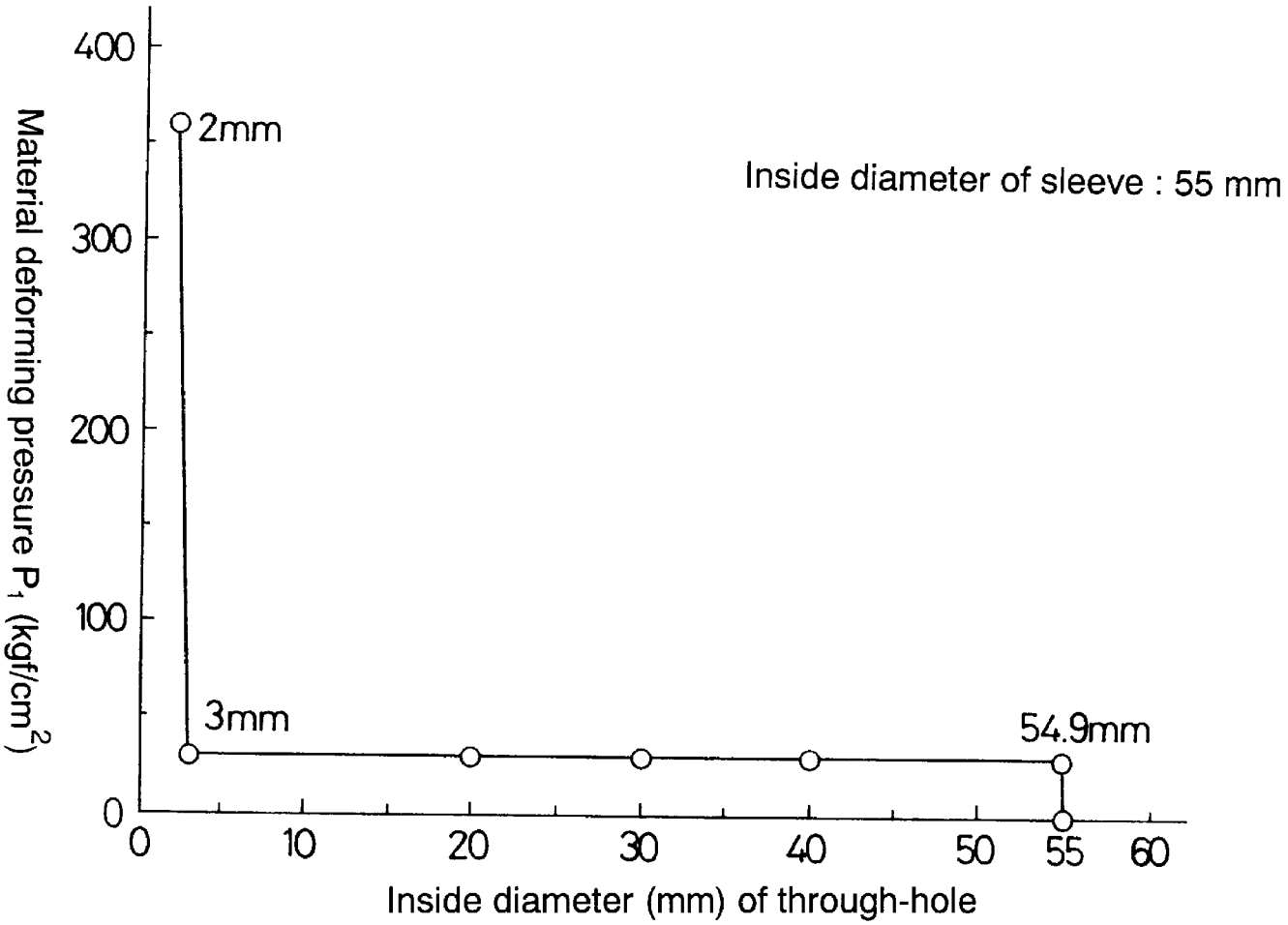
FIG. 21 is a graph illustrating the relationship between the inside diameter of a through-hole and the material deforming pressure $P_1$.

[IV] Relationship between the inside diameter of the through-hole 7 and the material deforming pressure $P_1$ Using the example 1 (see Table 1) of the example 1 of the semi-molten aluminum alloy material 9, the relationship between the inside diameter of the through-hole 7 which was varied and the material deforming pressure $P_1$ was examined to provide results shown in FIG. 21, wherein the inside diameter of the sleeve 11 was 55 mm.

As apparent from FIG. 21, if the inside diameter of the through-hole 7 is equal to or larger than 3 mm, the material deforming pressure $P_1$ is constant. If the inside diameter of the through-hole 7 is smaller than 3 mm, the material deforming pressure $P_1$ permitting a plurality of solid phases to form bridges is sharply risen. The upper limit value for the inside diameter of the through-hole 7 is 54.9 mm from the relationship with the inside diameter of the sleeve 11 of 55 mm.

If the inside diameter of the sleeve 11 is 90 mm, the lower limit value of the through-hole 11 for the example 1 was also 3 mm, and the upper limit value was 89.9 mm.

In this way, the lower limit value of the inside diameter of the through-hole 7 depends upon whether or not the bridges are formed, and such lower limit value has no relation to the inside diameter of the sleeve 11.

The casting material in the present invention is not limited to the aluminum alloy material and the iron alloy material.

What is claimed is:

1. A thixocasting process comprising the steps of: subjecting a casting material to a heating treatment to prepare a semi-molten casting material having solid and liquid phases coexisting therein, providing a through-hole for applying a constricting effect to said semi-molten casting material in a flow path for said semi-molten casting material leading to a cavity in a casting mold, and exerting the semi-molten casting material under a pressure into said cavity in said casting mold, wherein said pressure is a material deforming pressure $P_1$ immediately before said semi-molten casting material starts to flow into said through-hole and is used as a parameter for discriminating the satisfactory filling and the poor filling of said semi-molten casting material into said cavity.

2. A thixocasting process according to claim 1, wherein said material deforming pressure $P_1$ is equal to 6.7 MPa.

3. A thixocasting process comprising the steps of: subjecting a casting material to a heating treatment to prepare a semi-molten casting material having solid and liquid phases coexisting therein, and then exerting the semi-molten casting material under a pressure into a cavity in a casting mold, wherein a through-hole passing pressure $P_2$ when said semi-molten casting material is passed through the through-hole is used as a parameter for discriminating the satisfactory filling and the poor filling of said semi-molten casting material into said cavity.

4. A thixocasting process comprising the steps of: subjecting a casting material to a heating treatment to prepare a semi-molten casting material having solid and liquid phases coexisting therein, providing a through-hole for applying a constricting effect to said semi-molten casting material in a flow path for said semi-molten casting material leading to a cavity in a casting mold, and exerting the semi-molten casting material under a pressure into said cavity in said casting mold, wherein said pressure is a material deforming pressure $P_1$ immediately before said semi-molten casting material starts to flow into said through-hole and is set in a range of $P_1 \leqq 6.7$ MPa.

5. A thixocasting process according to claim 1, 2, 3 or 4, wherein a primary crystal in said casting material assumes a spherical shape.

* * * * *